United States Patent [19]

Mori et al.

[11] Patent Number: 4,509,397

[45] Date of Patent: Apr. 9, 1985

[54] PUNCH AND PERFORATION JIG ASSEMBLY HAVING POSITION MAINTAINING FEATURE

[75] Inventors: Chuzo Mori, Funabashi; Jun Watanabe, Matsudo; Katsutaka Kudo, Tsuchiura, all of Japan

[73] Assignee: Carl Manufacturing Co., Ltd., Tokyo, Japan

[21] Appl. No.: 532,488

[22] Filed: Sep. 15, 1983

[30] Foreign Application Priority Data

Sep. 27, 1982 [JP] Japan ..... 57-145873[U]
May 30, 1983 [JP] Japan ..... 58-81502[U]
May 30, 1983 [JP] Japan ..... 58-81500[U]

[51] Int. Cl.[3] ..... B26D 1/14

[52] U.S. Cl. ..... 83/453; 83/560; 83/618; 83/619; 83/633

[58] Field of Search ..... 83/618–622, 83/632, 633, 588, 453, 560

[56] References Cited

U.S. PATENT DOCUMENTS 1,567,374 12/1925 Keene ..... 83/588
2,638,986 5/1953 Emmer ..... 83/633 X
3,073,199 1/1963 Yerkes ..... 83/560 X

*Primary Examiner*—James M. Meister
*Attorney, Agent, or Firm*—Parkhurst & Oliff

[57] ABSTRACT

A perforator of enhanced performance is disclosed which comprises a punch and a perforation jig comprising upper and lower oblong sheet retainer plates adapted to hold paper sheets, so that in the course of perforation, the perforation jig will retain the punch fast in position with respect to the paper sheets and prevent the punch from being shaken in the vertical direction relative to the perforation jig. The perforator of this invention is constructed so that when the front portion of the punch is abutted against the upper sheet retainer plate forming part of the perforation jig, a punch-supporting member of the lower sheet retainer plate protruding outwardly from the upper sheet retainer plate advances into a recess extended from the front side to the rear side of the punch adapted to receive insertion of paper sheets and, consequently, the perforation jig is allowed to hold the punch safely.

22 Claims, 29 Drawing Figures

FIG. 3
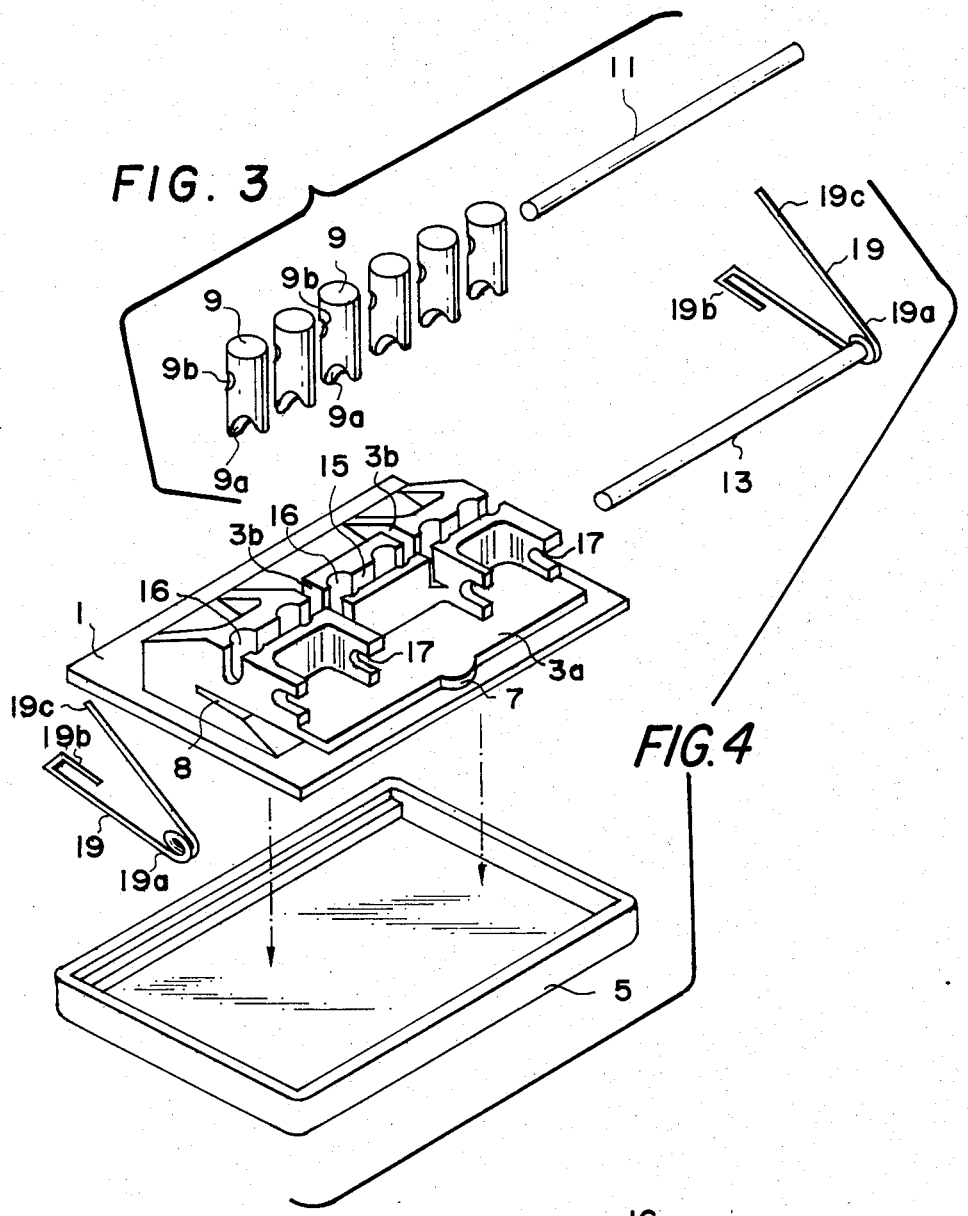
FIG. 4
FIG. 5
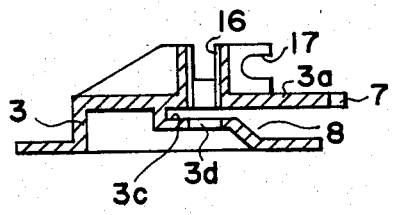

PUNCH AND PERFORATION JIG ASSEMBLY HAVING POSITION MAINTAINING FEATURE

BACKGROUND OF THE INVENTION

For use in a loose leaf binder, paper sheets having holes perforated in advance therein at prescribed positions are available in the market. A user of the loose leaf binder, therefore, is free to purchase these perforated paper sheets and file them in the loose leaf binder. There are times, however, when he is compelled to file in the loose leaf binder reproduced copies and catalogs which have no perforations at all.

The conventional multi-hole punch intended for punching holes in such unperforated paper sheets so that they may be filed in the loose leaf binder is so voluminous as to occupy much space and too expensive to find widespread acceptance. Thus, most users of loose leaf binders have been forced to endure the great inconvenience involved in punching as many holes in paper sheets as desired by the use of a one-hole punch, for example. Such devices are described in Japanese Utility Model Application No. SHO 54(1979)-116466, Japanese Utility Model Application No. SHO 54(1979)-127930, etc.

These perforators share a basic construction in which a one- or two-hole punch is provided in the front portion thereof with projections or depressions and possesses on the upper or lower side of these projections or depressions a recess extended from the front end to the rear end and adapted to receive insertion of superposed paper sheets. Separate from the punch are two oblong sheet retainer plates, one disposed on top of the other, with the longitudinal ends thereof pivotally attached to each other. A perforation jig is included which is provided therein with a plurality of punch-positioning depressions or projections, adapted to engage respectively with the projections or depressions of the aforementioned punch and spaced at fixed intervals along the longitudinal edge of either of the two oblong sheet retainer plates or along the longitudinal edge of the pivotally attached side of either or both of the two superposed sheet retainer plates.

With the perforator of this construction, paper sheets are neatly arranged by a sheet positioner attachably disposed on the aforementioned perforation jig and are then held fast in position between the two sheet retainer plates, with the leading ends of the paper sheets protruding from the side of the jig on which the punch-positioning depressions or projections are disposed. The punch is abutted against the protruding ends of the paper sheets so that the recess in the front side of the punch may receive the leading ends of the paper sheets and the projections or depressions in the front portion of the punch will come into engagement with the punch-positioning depressions or projections on the jig. In this manner, as many holes as desired may be perforated at prescribed positions in the paper sheets.

This perforator, however, has the disadvantage that the punch secured in position with respect to the paper sheets still has freedom of motion with respect to the perforator, except for that portion of the perforator in which the projections or depressions in the front portion of the punch are fast engaged with the punch-positioning depressions or projections on the perforation jig. Thus the depressing force exerted upon the lever of the punch in the course of perforation will cause the punch itself to shake or vibrate in the vertical direction relative to the perforation jig possibly to the extent of rendering the work of perforation difficult to carry out or making the paper sheets slip out of their neat arrangement.

SUMMARY OF THE INVENTION

An object of this invention is to provide a perforator so constructed that a punch, once positioned with respect to a perforation jig, may be safely supported on the perforation jig so that it will not be shaken in the vertical direction relative to the perforation jig in the course of perforation, whereby the perforator will perform with enhanced efficiency.

Another object of this invention is to provide a perforator so constructed that even in paper sheets of great length, a multiplicity of holes may be easily perforated at prescribed intervals in one neat row, again with enhanced efficiency.

Yet another object of this invention is to provide a perforator so constructed that the number of holes to be perforated in given paper sheets may be freely altered and the length of intervals separating the adjacent holes perforated in the paper sheets may be freely altered, whereby the perforator will provide performance of further enhanced efficiency.

Other features and attendant advantages of this invention will become apparent to those skilled in the art in light of the following description of preferred embodiments illustrated in the accompanying drawings.

BRIEF DESCRIPTION OF THE DRAWINGS

FIG. 3 is a perspective view illustrating the relation between perforating edges and a shaft of the punch of FIG. 1.

FIG. 4 is a perspective view illustrating a base and peripheral members of the punch of FIG. 1.

FIG. 5 is a longitudinal cross section of the base.

FIG. 23 for perforation of 26 holes, FIG. 24 for perforation of 30 holes, FIG. 25 for perforation of 3 holes, and FIG. 26 for perforation of 4 holes respectively.

DETAILED DESCRIPTION OF THE INVENTION

The perforator of this invention comprises: a punch provided in the front portion thereof with projections or depressions and possessing a recess extended under the aforementioned projections or depressions from the front side toward the rear side thereof and adapted to receive paper sheets, and a perforation jig formed, separately from the aforementioned punch, of two oblong sheet retainer plates, one pivotally superposed on top of the other, with the longitudinal edges thereof pivotally attached to each other so as to allow the retainer plates to open and close freely with each other and grip paper sheets when closed. The aforementioned sheet retainer plate on the upper side is provided along the pivotally attached longitudinal edge thereof with a plurality of punch-positioning depressions or projections adapted to engage with corresponding projections or depressions of the punch and spaced by fixed intervals. The sheet retainer plate on the lower side is provided with a punch-supporting member protruded from the corresponding longitudinal edge adapted to enter the recess of the punch for reception of paper sheets when the front portion of the punch is abutted against the sheet retainer plate on the upper side.

Now, preferred embodiments of the present invention will be described below with reference to the accompanying drawings. It should be noted that these embodiments are purely illustrative of, and not in any respect limitative of, the present invention.

A typical perforator of this invention comprises a six-hole punch 1 illustrated in FIGS. 1 through 5 and a perforation jig 2 for holding paper sheets as illustrated in FIGS. 6 through 11.

Figure 1:
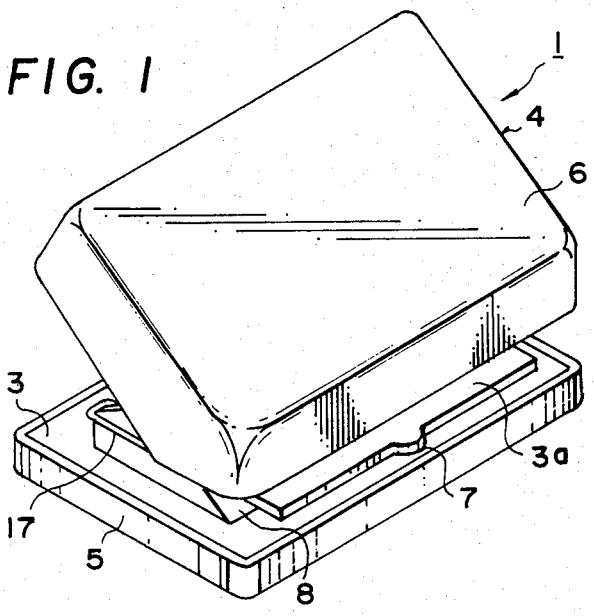
FIG. 1 is a perspective view illustrating a typical punch according to the present invention.

FIG. 1 illustrates the six-hole punch 1 in which 3 denotes a base, 4 a lever having its basal edge pivotally attached to the base 3 so as to be freely turned up and down about the basal edge relative to the base 3, 5 a cover attached to the base 3, and 6 a cover attached to the lever 4. A front portion 3*a* extending out of the base 3 is provided with a protuberance 7 for engagement with punch-positioning depressions formed on a perforation jig 2 which will be more fully described below. Below the portion containing this protuberance 7, a recess 8 for receiving insertion of paper sheets extends from the front portion 3*a* of the base 3 toward the rear side of the punch.

Figure 2:
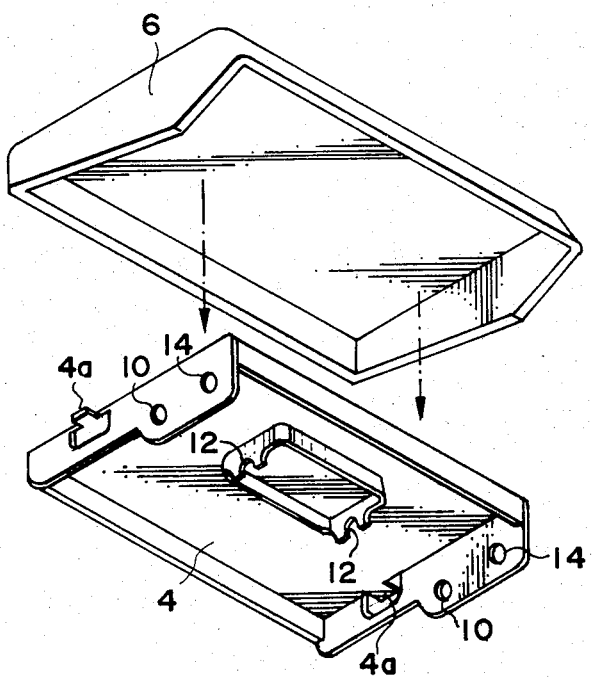
FIG. 2 is a perspective view illustrating a lever and a cover of the punch of FIG. 1 in their separated state.
Figure 6:
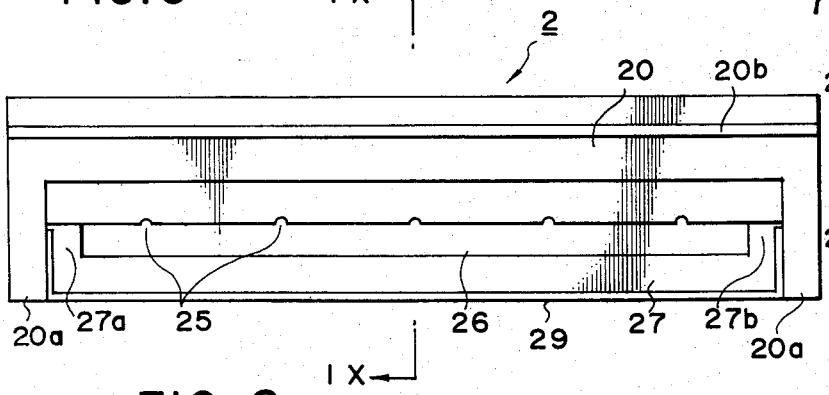
FIG. 6 is a plan view illustrating a typical perforation jig according to the present invention.
Figure 7:
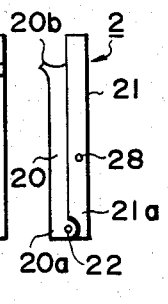
FIG. 7 is a side view illustrating the perforation jig of FIG. 6.
Figure 8:
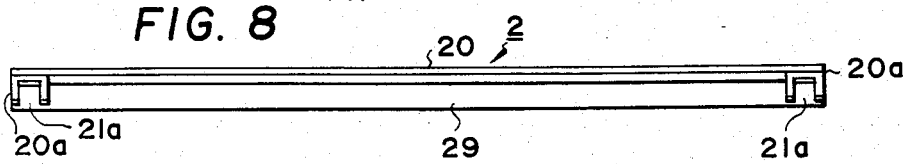
FIG. 8 is a front view of the perforation jig of FIG. 6.
Figure 9:
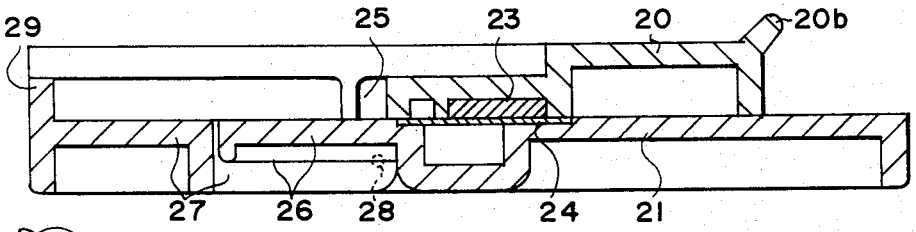
FIG. 9 is an enlarged cross section taken along the line IX—IX in the diagram of FIG. 6.
Figure 10:
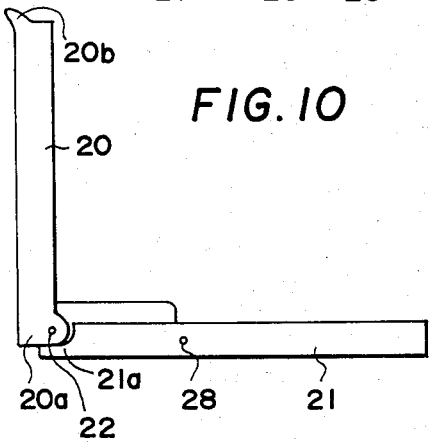
FIG. 10 is an enlarged side view of the perforation jig, illustrating the sheet retainer plate on the upper side in a state opened relative to a sheet retainer plate on the lower side.

FIGS. 2 through 5 illustrate the punch 1 in its disassembled state. In FIG. 3, 9 denotes six perforating cutters in the shape of rods. The perforating cutters 9 have cutting edges 9*a* at their lower ends. These perforating cutters 9 are supported in position by the lever 4 when a shaft 11 is inserted through pierced holes 9*b* formed in the upper portions of the perforating cutters 9 and then crossed through holes 10 formed in the opposite lateral side walls of the lever 4 as illustrated in FIG. 2. On the rear side of the lever 4, two dents 12 are formed corresponding to the two holes 10, 10 as illustrated in FIG. 2, so that the shaft 11 may be prevented from being bent by external force exerted on the perforating cutters.

In FIG. 4, 13 denotes a shaft for pivotally attaching the lever 4 to the base 3 via a hole 14 (FIG. 2).

As illustrated in FIG. 4, a groove 15 for guiding the vertical motion of the shaft 11 is provided substantially in the central portion of the base 3 and as many holes 16 as perforating cutters 9 are formed in a row along this groove for the purpose of guiding the vertical motion of these perforating cutters 9. In front of the groove 15, a plurality of dents 17 are formed for the purpose of admitting into fast engagement the aforementioned shaft 13. In the portion of the base 1 where the groove 15 is formed, two dents 3*b* disposed at a distance from each other in a direction perpendicular to the groove 15 serve to admit a protuberance 18 (FIG. 2) containing the dents 12 for the lever 4 during the descent of the lever.

In FIG. 4, 19 denotes a wire spring. The two wire springs 19 have their respective central coil portions 19*a* inserted around the opposite edge portions of the shaft 13, their hooked ends 19*b* pivotally attached to the rear side of the base 3, and the other straight ends 19*c* pressed against projected members 4*a* disposed outwardly on the lateral sides of the lever 4. Thus, these wire springs 19 constantly exert a force upon the lever 4 in the direction of keeping the lever 4 raised relative to the base 3. FIG. 5 shows a side view of the punch base wherein the relationship of the parts shown in FIG. 4 may be seen in the assembled state.

Now the perforation jig 2 will be described with reference to FIGS. 6–11. The perforation jig 2 comprises upper and lower oblong sheet retainer plates 20, 21 each of the shape of a rectangular picture frame lacking one long side. The upper and lower sheet retainer plates 20, 21 are made to open and close freely relative to each other by having their respective laterally protruded longitudinal edges 20*a*, 21*a* pivotally attached to each other through the medium of a shaft 22. Longitudinally to the abutting surfaces of the sheet retainer plates 20, 21, a magnetic plate 23 may be fastened on the sheet retainer plate 20 side and a metallic plate 24 on the sheet retainer plate 21 side. The attraction caused between the magnetic plate 23 and the metallic plate 24 causes paper sheets to be gripped tightly between the opposed sheet retainer plates.

A plurality of punch-positioning depressions 25 adapted to engage with the projections 7 in the front portion of the punch 1 are formed along the longitudinal edge of the upper sheet retainer plate 20 on the pivotally attached side. From the longitudinal edge of the lower sheet retainer plate 21 on the pivotally attached side, there is protruded a punch supporting member 26 which fits into the sheet insertion groove 8 of the punch 1 when the upper and lower sheet retainer plates 20, 21 are held in their mutually closed state and the front part of the punch 1 is abutted against the upper sheet retainer plate 20.

A sheet-positioning plate 27, disposed substantially in the middle of the lower sheet retainer plate 21, has its laterally protruded longitudinal ends 27*a* pivotally attached to the lower sheet retainer plate 21. This sheet-positioning plate 27 is provided with a raised edge 29 at the position where the raised edge 29 is opposed across a space to the plurality of punch-positioning depressions 25 so as to enable the leading ends of paper sheets to protrude from the upper and lower sheet retainer plates 20, 21 and come into contact with it. The sheet-positioning plate 27 is adapted so that a part thereof will collide with the edge of the punch-supporting member 26 of the lower sheet retainer plate 21 and, consequently, prevent the sheet-positioning plate 27 itself from rotating above the lower sheet retainer plate 21. Once the paper sheets have been positioned for perforation, the sheet-positioning plate 27 is permitted to rotate downwardly below the lower sheet retainer plate 21. Here denoted by 20*b* is a handle for the upper sheet retainer plate 20.

The operation involved in forming a multiplicity of holes in paper sheets by the use of a perforator of the foregoing construction will be described below.

Figure 11:
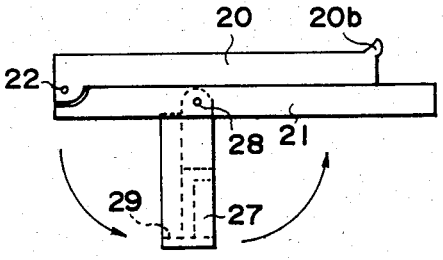
FIG. 11 is an enlarged side view of the perforation jig, illustrating the sheet retainer plate on the upper side which has been pulled down from the position shown in FIG. 10 onto the sheet retainer plate on the lower side and the sheet-positioning plate which has been rotated downwardly relative to the sheet retainer plate on the lower side.

Preparatory to retention of paper sheets in the perforation jig 2, the upper sheet retainer plate 20 is rotated about the shaft 22 as its fulcrum and is brought to a raised position relative to the lower sheet retainer plate 21. At the same time, the sheet-positioning plate 27 with part thereof kept in contact with the punch-supporting member 26 is disposed flush with the lower sheet retainer plate 21. In the resultant condition, paper sheets 30 are placed on the lower sheet retainer plate 21, with the leading ends thereof held in contact with the raised edge 29 of the paper-positioning plate 27. Then, the upper sheet retainer plate 20 is pulled down and superposed on the lower sheet retainer plate 21, so that the paper sheets 30 will be nipped fast by the attraction between the magnetic plate 23 and the metallic plate 24. Thereafter, the sheet-positioning plate 27 is rotated downwardly below the lower sheet retainer plate 21 as illustrated in FIG. 11.

Figure 12:
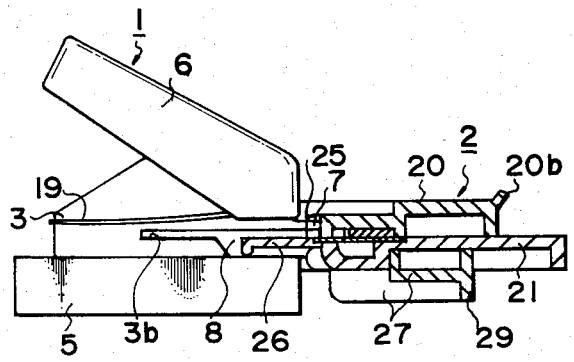
FIG. 12 is a diagram illustrating the condition in which the punch of FIG. 1 abutted against the perforation jig of FIG. 6.
Figure 13:
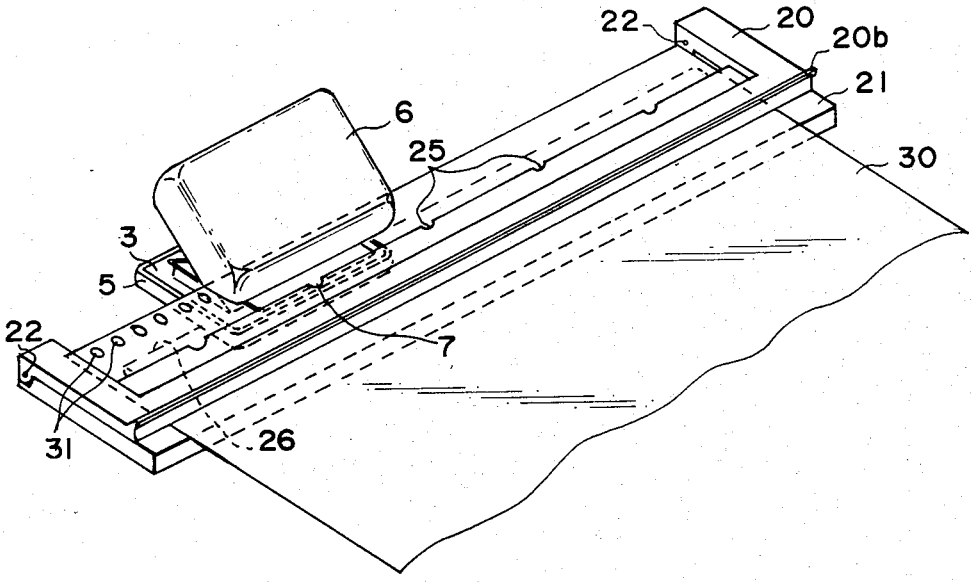
FIG. 13 is a perspective view illustrating the condition in which the punch of FIG. 1 and the perforation jig of FIG. 6 are jointly put to use.

After the paper sheets 30 have been positioned and retained as described above, they will assume a state in which the leading ends of the paper sheets 30 protrude from the perforation jig 2 as illustrated in FIG. 13. Then, the leading ends of the paper sheets 30 and the punch-supporting member 26 of the lower sheet retainer plate 21 are inserted into the recess 8 of the punch 1 which has been abutted against the perforation jig 2. At the same time, the projections formed in the front portion of the punch 1 are brought into engagement with the punch-positioning depressions 25 of the upper sheet retainer plate 20, with the result that the front end of the punch 1 will collide with the lateral edge of the upper sheet retainer plate 20. The resulting state is illustrated in FIGS. 12 and 13.

By lowering the cover 5 mounted on the lever 4, six equally spaced holes 31 are formed in the paper sheets 30. By repeating this perforation procedure, a total of thirty holes 31 can be formed with the perforator shown in FIG. 13. During this perforation procedure, since the punch-supporting member 26 of the lower sheet retainer plate 21 thrusts partially into the groove 8 of the six-hole punch 1, the punch-supporting member 26 prevents the punch 1 from shaking in the vertical direction in the course of perforation.

Figure 14:
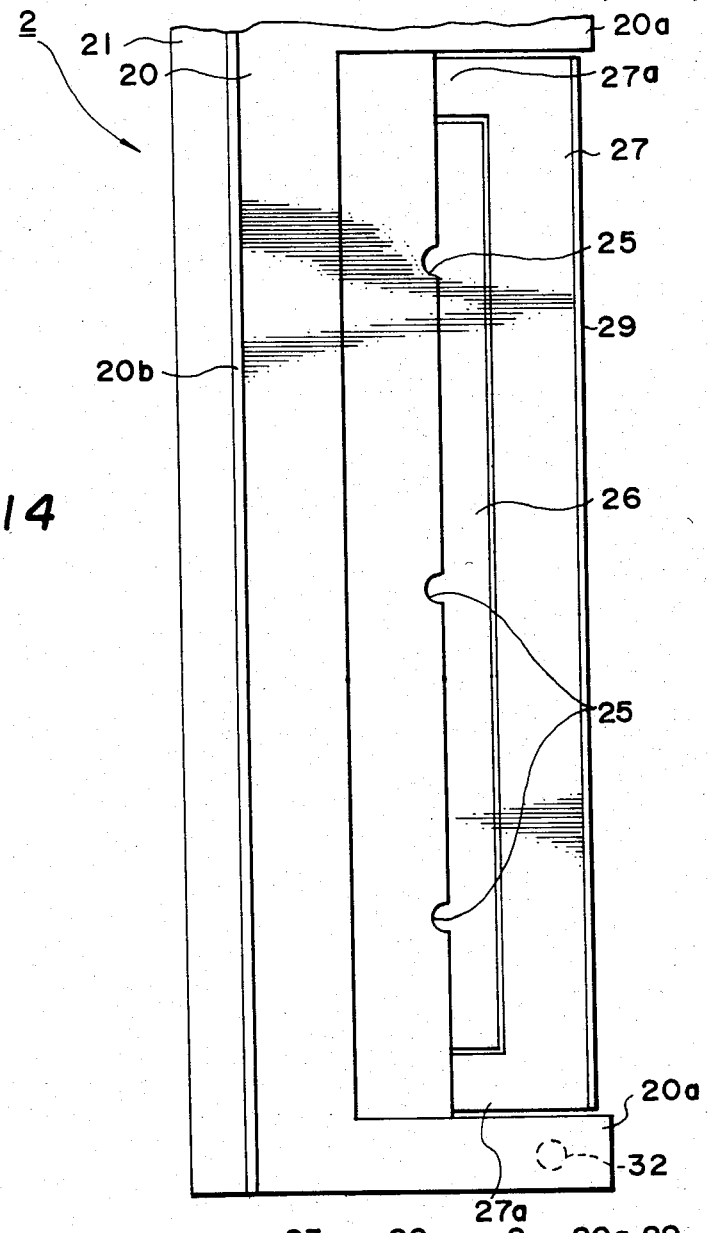
FIG. 14 is a plan view illustrating a second version of the perforation jig according to the present invention.
Figure 15:
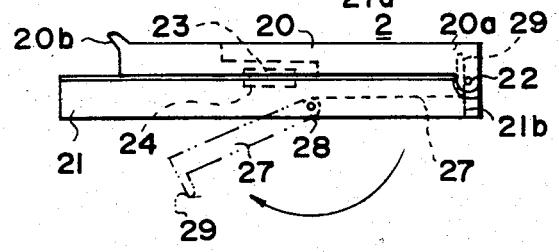
FIG. 15 is a side view illustrating the perforation jig of FIG. 14.
Figure 16:
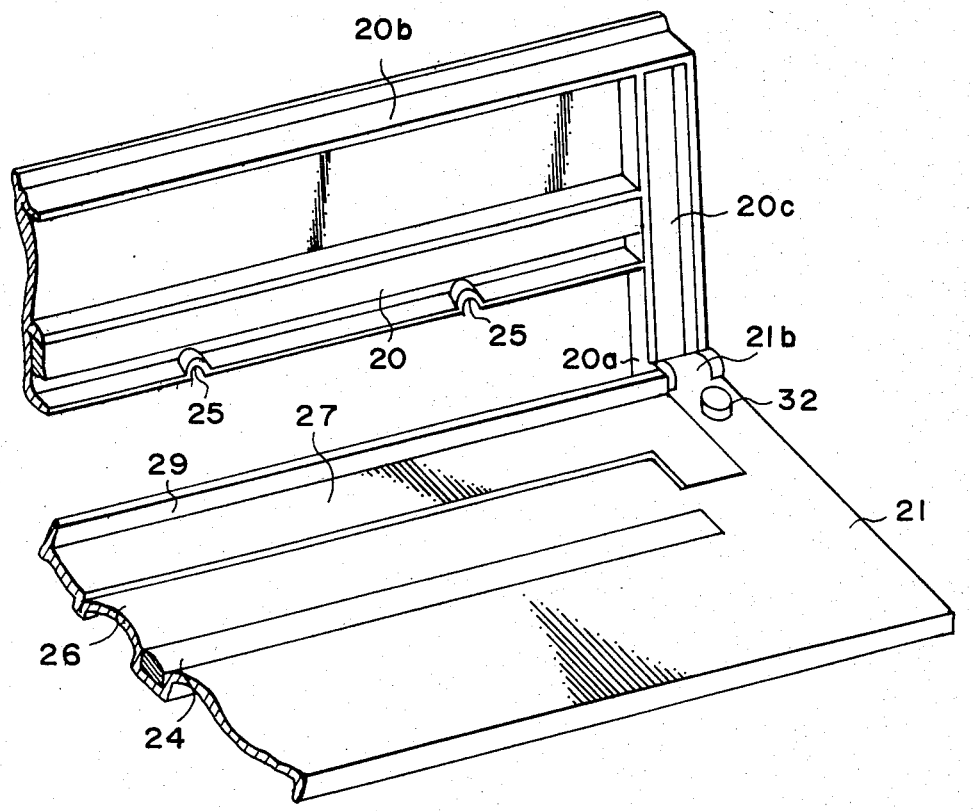
FIG. 16 is an enlarged perspective view illustrating part of the perforation jig of FIG. 14.

FIGS. 14 to 16 illustrate a second version of the perforation jig 2. This perforation jig 2 is identical with that of FIGS. 6 to 13 except that it is additionally provided with at least one projection 32 adapted to fit into any of the holes perforated in the paper sheets. The parts of this perforation jig which are the same as those illustrated in FIGS. 6 to 13 are denoted by like symbols. Descriptions of these parts are omitted to avoid unnecessary repetition.

The projection 32 is raised upwardly from the lower sheet retainer plate 21 near one end 21*a* thereof on the pivotally attached side. A portion 20*c* of the upper sheet retainer plate 20 near one end 20*a* thereof corresponding to the aforementioned one end 21*a* of the lower sheet retainer plate 21 has a depressed shape for admitting the projection 32. This projection 32 is formed at such a position that it will fall on the extension of the line of holes formed by the six-hole punch in paper sheets during the perforation procedure and it will stand at a distance, which is a certain integral multiple of the distance between adjacent holes formed in the paper sheets, from the nearest of the holes so perforated. Optionally, the projection 32 may project downwardly from the corresponding position of the upper sheet retainer plate 20 and the corresponding portion of the lower sheet retainer plate 21 may be depressed so as to admit the projection 32.

The position and number of projections 32 designed to fit into any of the holes formed in paper sheets may be altered depending on the type of the aforementioned punch and the pitch of the punch-positioning depressions or projections. For example, where a one-hole punch and a perforation jig designed to punch a total of three holes in one procedure are used, the projection 32 will be disposed at a position which is separated from the last of the three holes by an integral multiple of the distance between the adjacent holes.

Figure 17:
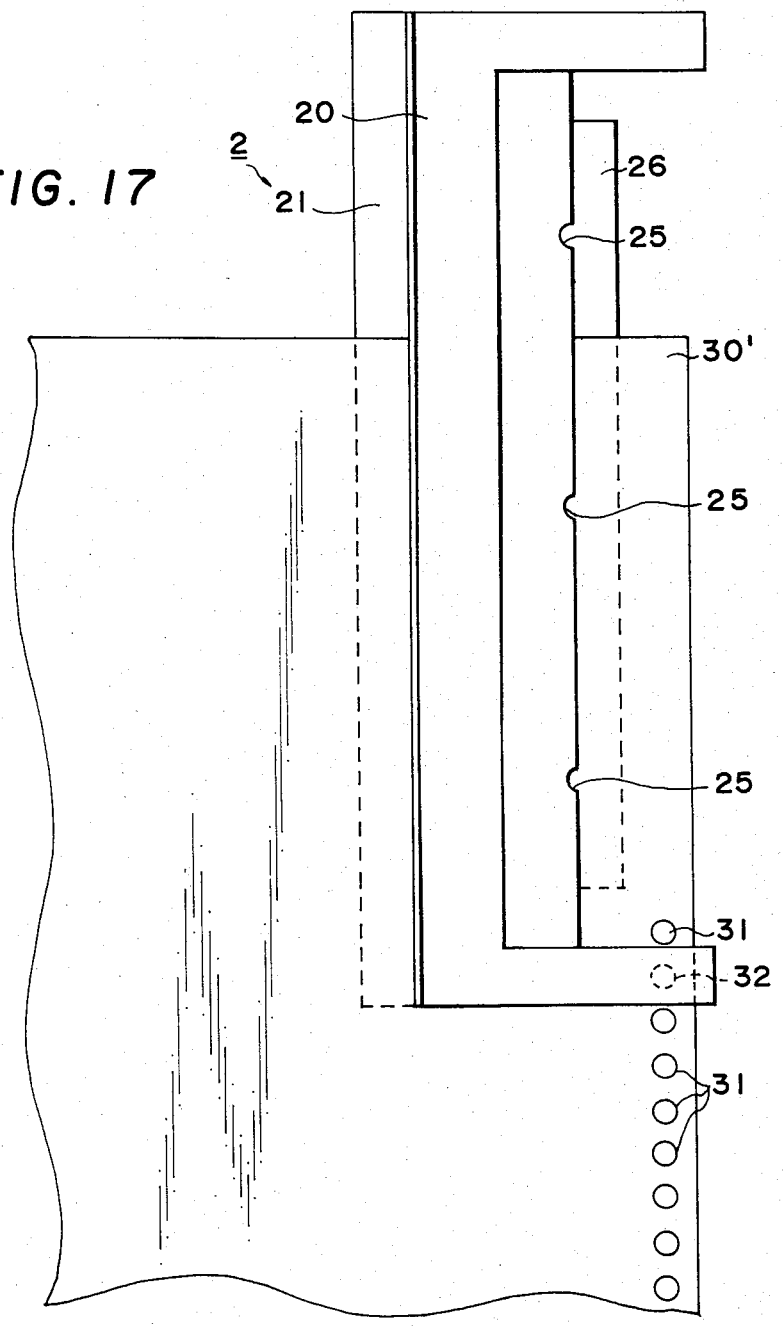
FIG. 17 is a plan view illustrating the condition in which paper sheets which have been perforated by the condition of the perforation jig of FIG. 14 and the punch of FIG. 1 are slid sideways to be further perforated.
Figure 18:
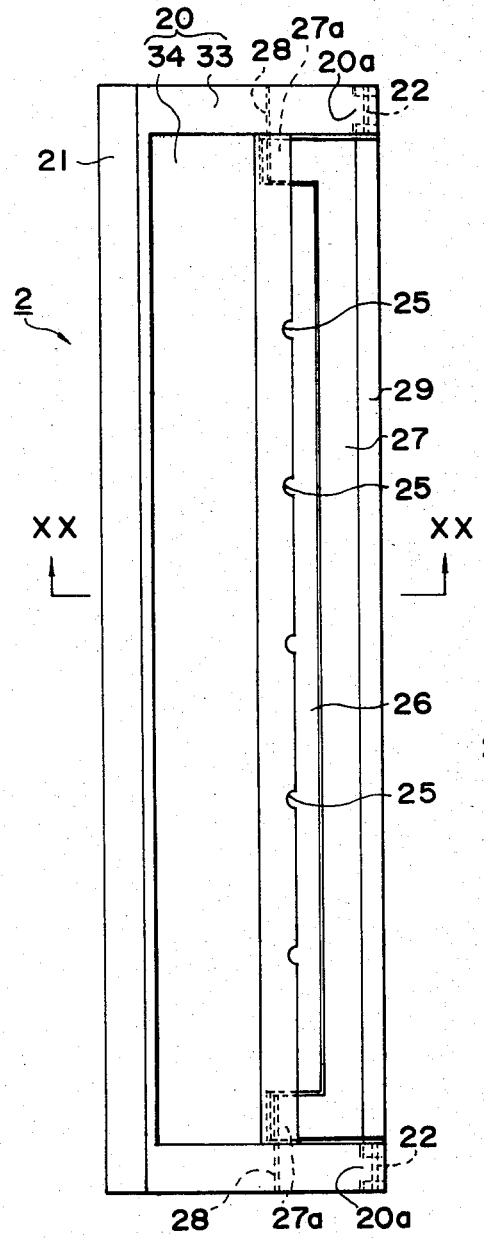
FIG. 18 is a plan view illustrating a third version of the perforation jig according to the present invention.
Figure 19:
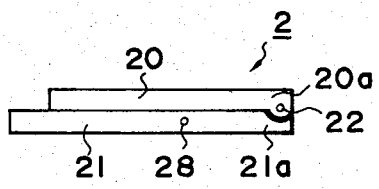
FIG. 19 is a side view illustrating the perforation jig of FIG. 18.

In the perforator using the perforation jig 2 of the aforementioned construction, a multiplicity of holes are formed in long paper sheets 30' (FIG. 17) in much the same way as in the first embodiment described above. Then to perforate further holes 31 along the length of an edge of the paper, the upper sheet retainer plate 20 is opened relative to the lower sheet retainer plate 21 to release the paper sheets 30'. The paper sheets 30' are then slid along the raised edge 20 of the sheet-positioning plate 27 until the last of the holes already formed as illustrated in FIG. 18 is fitted around the projection 32, and the upper sheet retainer plate 20 is closed onto the lower sheet retainer plate 21 to grip the paper sheets. By repeating the aforementioned procedure on the part of the paper sheets protruding from the perforation jig 2, a multiplicity of holes 31 is formed in one regularly spaced row. Thus, this perforation jig provides performance of enhanced efficiency.

FIGS. 18 to 26 illustrate a third version of the perforation jig according to the present invention. To improve utility, this perforation jig is so adapted that the portion of the upper sheet retainer plate 20 in which a plurality of punch-positioning depressions 25 are provided is rendered interchangeable. The same parts of this perforation jig 2 as those used in the perforation jig 2 of the first and the second versions are denoted by like symbols. Descriptions of these parts will be omitted to avoid unnecessary repetition.

This perforation jig 2 further comprises a sheet-retaining member 33 adapted to actuate the upper sheet retainer plate 20 and the lower sheet retainer plate 21 jointly to grip paper sheets and a plate-like punch-positioning member 34 adapted to be detachably mounted on the upper side of the sheet-retaining member 33.

Figure 20:
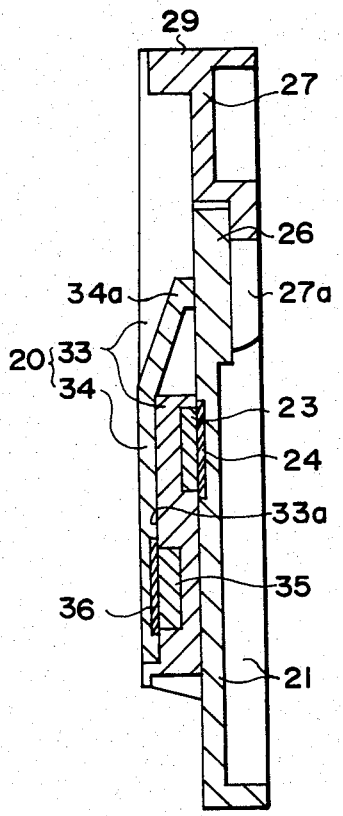
FIG. 20 is an enlarged cross section taken along the line XX—XX in the diagram of FIG. 18.
Figure 21:
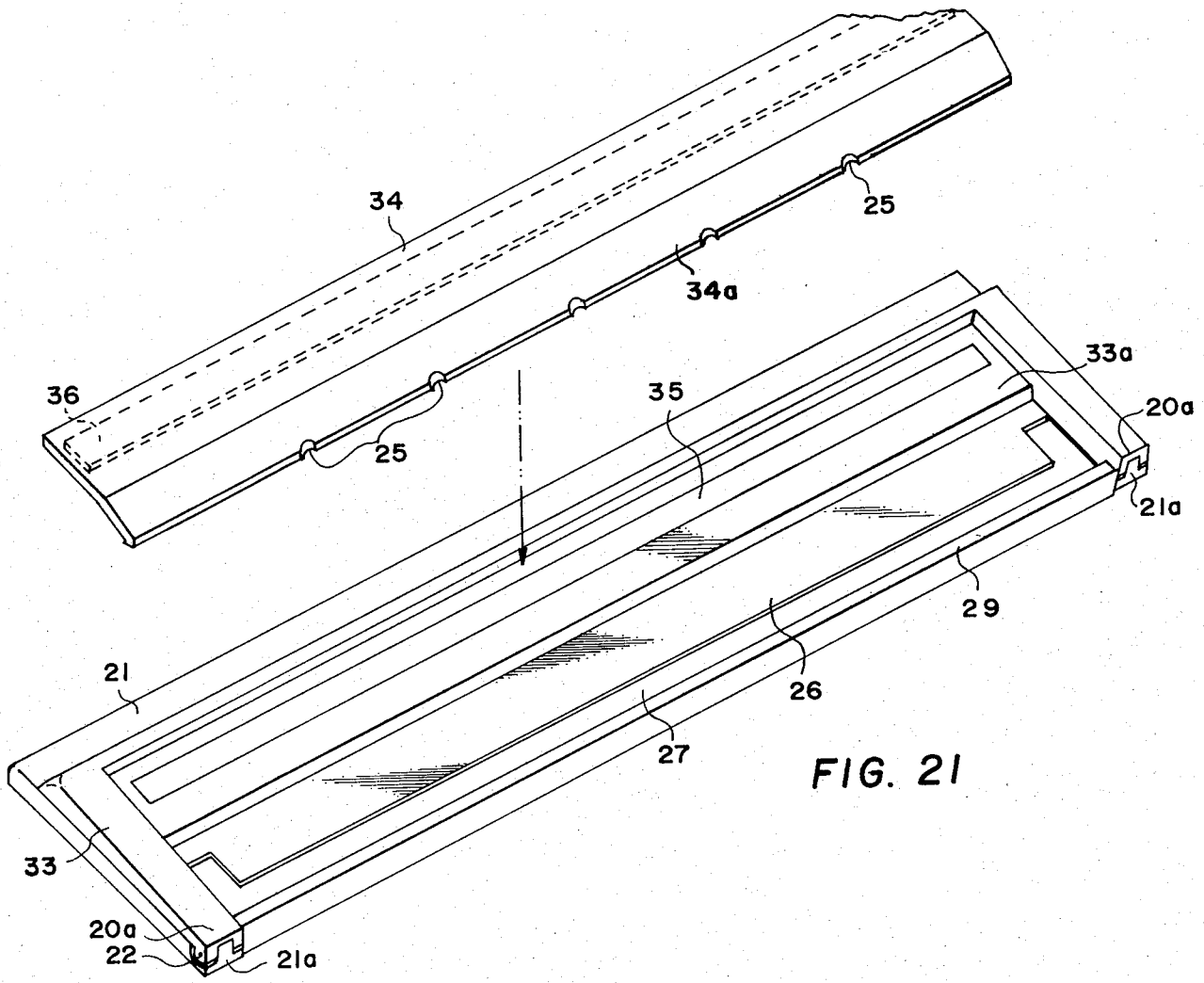
FIG. 21 is a perspective view illustrating the condition in which a punch positioner has been separated from a sheet retainer in the perforation jig of FIG. 18.
Figure 22:
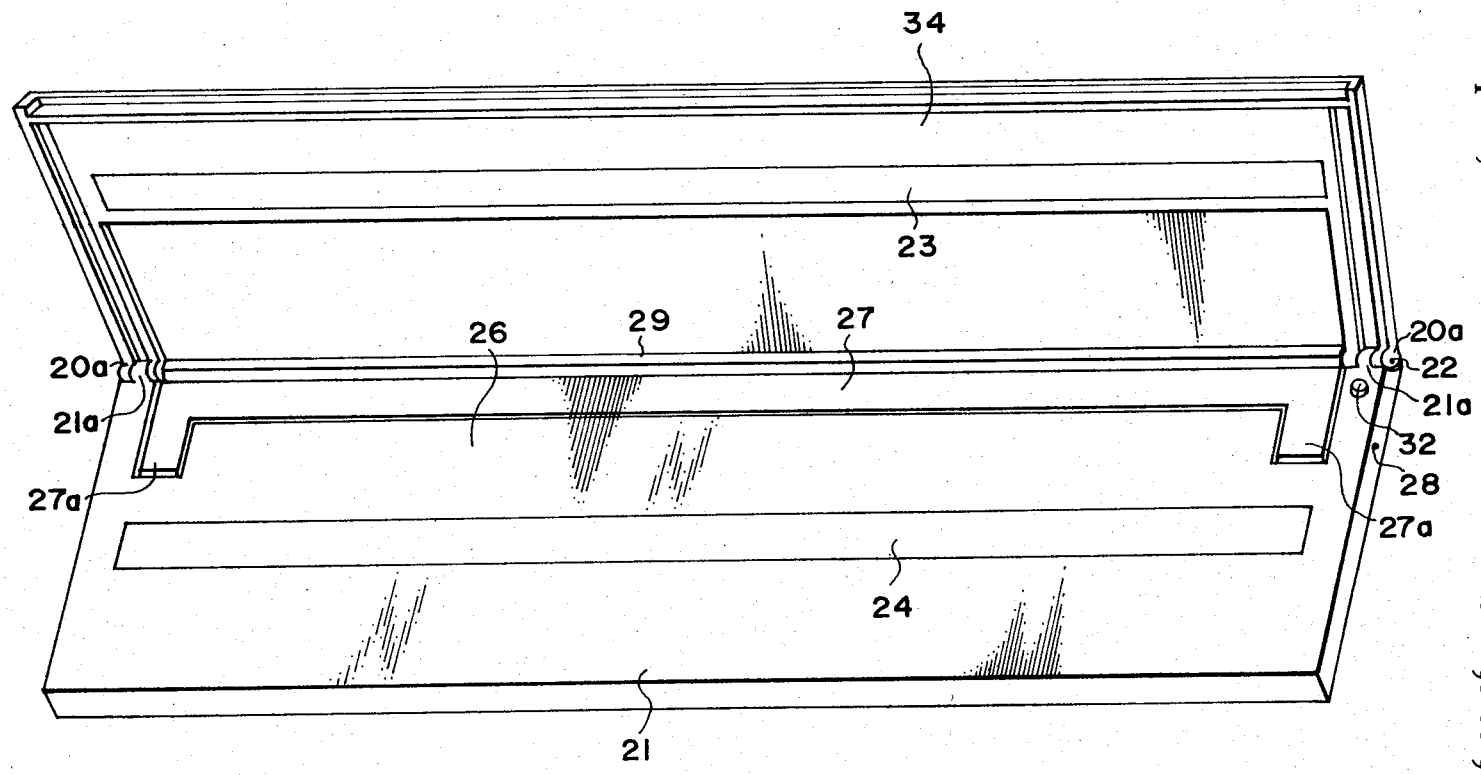
FIG. 22 is a perspective view illustrating the condition in which a sheet retainer plate on the upper side is opened relative to a sheet retainer plate on the lower side in the perforation jig of FIG. 18.

As illustrated in FIGS. 20 and 21, the upper side of the sheet-retaining member 33 forms a stepped portion 33*a* serving to accommodate therein the punch-positioning member 34. A magnetic plate 35 is fastened to the stepped portion 33*a*. The punch-positioning member 34 has a magnetic plate 36 attached to the bottom side thereof at a position corresponding to that of the magnetic plate 35 in the stepped portion 33*a*. Thus, the stepped portion 33*a* keeps the punch-positioning member 34 fast in position by virtue of the attraction generated between the magnetic plates 35, 36.

Figures 23, 24, 25, 26:
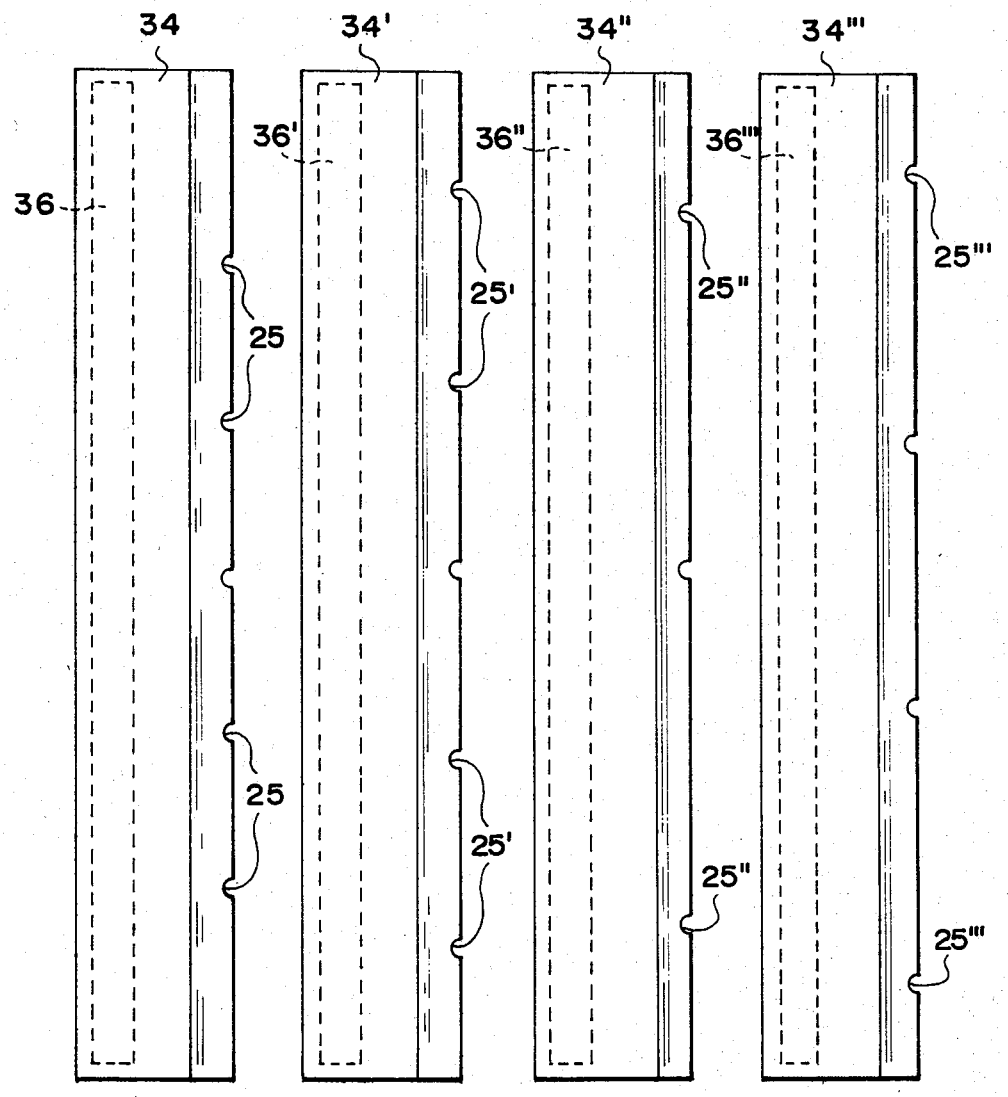
FIGS. 23–26 are plan views illustrating different punch positioners.

The punch-positioning member 34, while held fast on the sheet-retaining member 33, has one longitudinal edge 34*a* thereof protruded from the stepped portion 33*a* of the sheet-retaining member 33. Along the edge 34*a* is disposed a plurality of regularly spaced punch-positioning depressions 25 adapted to engage with the projections 7 formed in the front part of the punch 1. The punch-positioning member 34 shown in FIG. 23 is intended to enable the six-hole punch 1 to perforate 26 holes, part of which overlap during the perforation, in paper sheets. Two or more such punch-positioning members 34 may be interchangeably used, depending on the kind of the punch, the number of holes desired to be formed in the paper sheets, and the positions of such holes.

Where 30 holes, 3 holes, or 4 holes are desired to be perforated in given paper sheets, for example, there may be used respectively the 30-hole punch-positioning member 34' illustrated in FIG. 24, the 3-hole punch-positioning member 34'' illustrated in FIG. 25, or the 4-hole punch-positioning member 34''' illustrated in FIG. 26. These punch-positioning members 34', 34'', and 34''' have the same size as the 26-hole punch-positioning member 34 illustrated in FIG. 23 and they have punch-positioning depressions 25', 25'', and 25''' at different intervals from the punch-positioning depressions 25. They have magnetic plates 36', 36'', and 36''' provided respectively at the positions corresponding to that on the 26-hole punch-positioning member 34.

The punches to be used in combination with the punch-positioning members 34', 34'', and 34''' are the six-hole punch 1 of FIG. 1 for the member of FIG. 24 and the one-hole punch (not shown) of the same construction as the six-hole punch for the members of FIGS. 25 and 26.

In this third version of the perforation jig of the invention, the punch-positioning members 34, 34', 34'', and 34''' are attached to their respective sheet-retaining members 33 by virtue of magnetic attraction. Optionally, this attachment may be obtained by some other fixing means such as, for example, a bolt and a nut. One of the magnetic plates 35, 36 may be substituted by a metallic plate, so that the punch-positioning member 34 will be detachably fastened to the sheet-retaining member 33 by the magnetic attraction generated between the metallic plate and the remaining magnetic plate.

Figure 27:
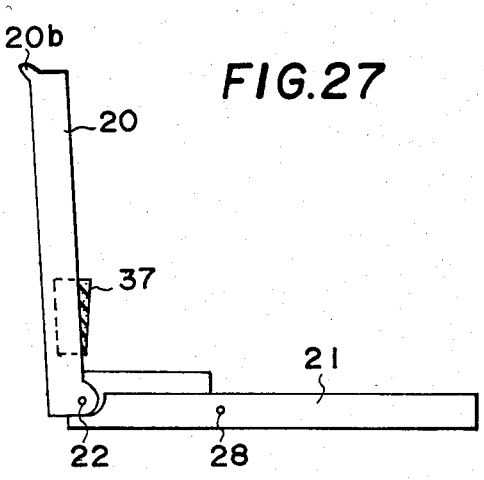
FIG. 27 is a side view illustrating a fourth version of the perforation jig according to the present invention.
Figure 28:
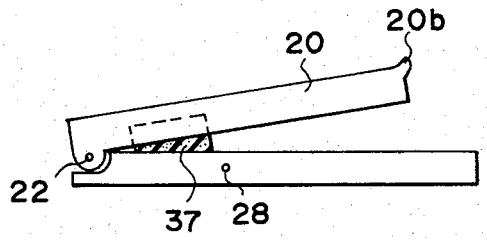
FIG. 28 is a side view illustrating the condition in which a sheet retainer plate on the upper side is held at an inclination relative to a sheet retainer plate on the lower side in the perforation jig of FIG. 27.
Figure 29:
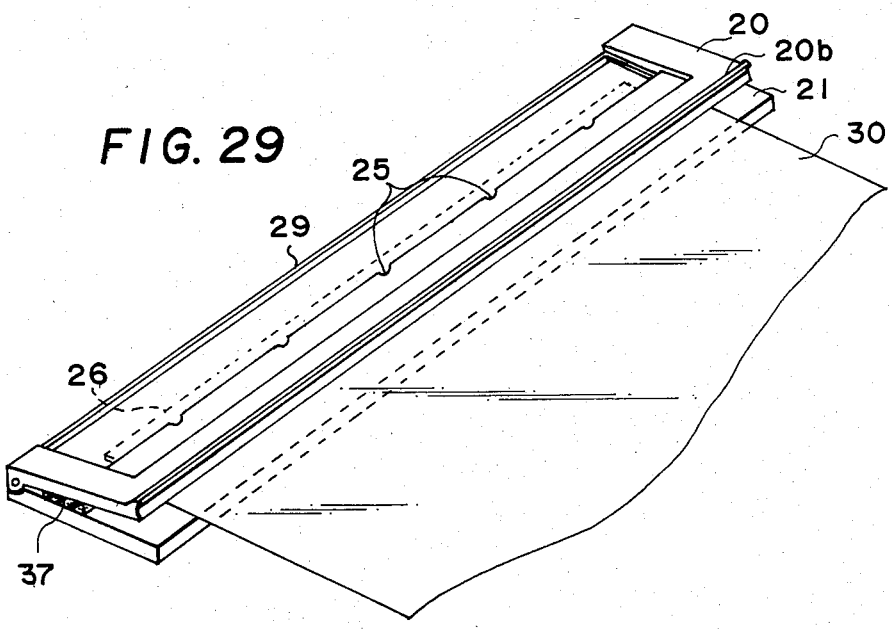
FIG. 29 is a perspective view illustrating the condition in which paper sheets are inserted between the upper and lower sheet retainer plates of the perforation jig of FIG. 28.

FIG. 27 to FIG. 29 illustrate a fourth version of the perforation jig 2. This perforation jig 2, for the purpose of further enhancing utility over the perforation jig 2 of the first embodiment described above, is provided at each of the longitudinal ends of the upper sheet retainer plate 20 with an elastically deformable member such as sponge member 37 adapted to hold the upper sheet retainer plate 20 in such a position relative to the lower sheet retainer plate 21 as to form an angle convenient for insertion of paper sheets between the upper and lower sheet retainer plates 20, 21. Owing to this sponge member 37, a gap is kept between the upper and lower sheet retainer plates 20, 21 as illustrated in FIGS. 28 and 29. After the paper sheets have been inserted into this gap and positioned correctly therein, they are readily retained fast in position when the upper sheet retainer plate 20 is pressed onto the lower sheet retainer plate 21. This perforation jig 2 has no possibility of the paper sheets slipping out of position after they have been positioned and subsequently held fast in position in the same way as in the first through third embodiments of the perforation jig 2.

The sponge members 37 may be formed both on the upper and lower sheet retainer plates 20, 21. They may be formed only on the lower sheet retainer plate 21. Otherwise, they may be formed one each at the mutually opposite longitudinal ends of the upper and lower sheet retainer plates 20, 21.

In any of the perforators so far described, the projections 7 are formed in the front part of the punch 1 and the punch-positioning depressions 25 are formed in the perforation jig 2. They may change places as occasion demands.

Because the present invention is constructed as described above, during the procedure of perforation, the punch can be safely supported by the perforation jig by causing the projections or depressions formed in the punch to be engaged with the corresponding punch-positioning depressions or projections provided on the perforation jig and by allowing the punch-supporting member formed on the perforation jig to be inserted into the recess for insertion of paper sheets formed in the punch. Thus, the punch is prevented from shaking in the vertical direction relative to the perforation jig even when power is applied to the punch in the course of perforation. Problems such as difficulty of perforation and slippage of paper sheets due to vibration of the punch which have been suffered with conventional perforators devoid of a punch-supporting member are precluded. Thus, this invention contributes immensely to improving the utility of a perforator.

What is claimed is:

1. A perforator which comprises:

a punch provided in a front portion thereof with at least one projection and possessing a recess extended under said projections from the front side toward the rear side thereof and adapted to receive insertion of paper sheets, and a separate perforation jig comprising upper and lower sheet retainer members, a front longitudinal edge of said upper sheet retainer member being pivotally attached to a front longitudinal edge of said lower sheet retainer member, said upper sheet retainer member being provided along the pivotally attached edge thereof with at least one punch-positioning depression adapted to engage with the projections of said punch, said perforating jig being provided with a protruding punch-supporting member on the side containing said punch-positioning depressions and adapted to enter said recess of said punch when the front portion of said punch is abutted against said upper sheet retainer member.

2. A perforator according to claim 1, wherein said punch supporting member protrudes from said front longitudinal edge of said lower sheet retainer member.

3. A perforator according to claim 1, wherein said upper sheet retainer member is provided with a plurality of said punch-positioning depressions, said punch-positioning depressions being spaced apart at equal intervals.

4. A perforator according to claim 1, wherein a magnetic member is disposed on one of the upper and lower sheet retainer members and a magnetic or metallic member is disposed on the other sheet retainer member in positions of said sheet retainer members which oppose when they are pivoted into a closed state.

5. A perforator according to claim 4, wherein magnetic members are disposed on each of the upper and lower sheet retainer members.

6. A perforator according to claim 1, wherein a sheet-positioning member adapted to abut against the leading ends of the inserted paper sheets is pivotally attached to the lower sheet retainer member.

7. A perforator according to claim 6, wherein at least one projection adapted to fit into any of a plurality of holes perforated by the punch in the paper sheets is disposed at at least one of the opposite longitudinal ends of either of the upper and lower sheet retainer member at a prescribed position which falls on an extension of a line connecting said plurality of perforated holes.

8. A perforator according to claim 1, wherein said upper sheet retainer member comprises a sheet-retaining member pivotally attached to said lower sheet retainer member and adapted to grip said paper sheets in cooperation with said lower sheet retainer member when in a pivotally closed position relative to said lower sheet retaining member, and an interchangeable punch-positioning member provided with said punch-positioning depressions, said punch-positioning member being selected so that the punch-positioning depressions or projections provided thereon suit the type of punch to be used, the number of holes desired to be perforated in the paper sheets, and the desired positions of such holes, said selected punch-positioning member being interchangeably attachable to said sheet-retaining member.

9. A perforator according to claim 8, wherein magnetic plates are fastened to opposed surfaces of said sheet-retaining member and said interchangeable punch-positioning member so that said punch-positioning member may be detachably fastened to said sheet-retaining member by virtue of magnetic attraction generated between said two magnetic member.

10. A perforator according to claim 8, wherein a magnetic member is fastened to a surface of one of said sheet-retaining member and said interchangeable punch-positioning member and a metallic member is fastened to an opposed surface of the other of said sheet-retaining member and punch-positioning member so that said punch-positioning member may be detachably fastened to said sheet-retaining member by virtue of magnetic attraction generated between said magnetic member and said metallic member.

11. A perforator according to claim 1, wherein an elastically deformable member adapted to keep said upper sheet retainer member at an angle relative to said lower sheet retainer member during insertion of paper sheets between said upper and lower sheet retainer members is provided at at least one end of at least one of the upper and lower sheet retainer members.

12. A perforator which comprises:

a punch provided in a front portion thereof with at least one depression and possessing a recess extended under said depression from the front side toward the rear side thereof and adapted to receive insertion of paper sheets, and a separate perforation jig comprising upper and lower sheet retainer members, a front longitudinal edge of said upper sheet retainer member being pivotally attached to a front longitudinal edge of said lower sheet retainer member, said upper sheet retainer member being provided along the pivotally attached edge thereof with at least one punch-positioning projection adapted to engage with the depression of said punch, said perforating jig being provided with a protruding punch-supporting member on the side containing said punch-positioning projection and adapted to enter said recess of said punch when the front portion of said punch is abutted against said upper sheet retainer member.

13. A perforator according to claim 12, wherein said punch supporting member protrudes from said front longitudinal edge of said lower sheet retainer member.

14. A perforator according to claim 12, wherein said upper sheet retainer member is provided with a plurality of said punch-positioning projections, said punch-positioning projections being spaced apart at equal intervals.

15. A perforator according to claim 12, wherein a magnetic member is disposed on one of the upper and lower sheet retainer members and a magnetic or metallic member is disposed on the other sheet retainer member in positions of said sheet retainer members which oppose when they are pivoted into a closed state.

16. A perforator according to claim 15, wherein magnetic members are disposed on each of the upper and lower sheet retainer members.

17. A perforator according to claim 12, wherein a sheet-positioning member adapted to abut against the leading ends of the inserted paper sheets is pivotally attached to the lower sheet retainer member.

18. A perforator according to claim 17, wherein at least one projection adapted to fit into any of a plurality of holes perforated by the punch in the paper sheets is disposed at at least one of the opposite longitudinal ends of either of the upper and lower sheet retainer members at a prescribed position which falls on an extension of a line connecting said plurality of perforated holes.

19. A perforator according to claim 12, wherein said upper sheet retainer member comprises a sheet-retaining member pivotally attached to said lower sheet retainer member and adapted to grip said paper sheets in cooperation with said lower sheet retainer member when in a pivotally closed position relative to said lower sheet retaining member, and an interchangeable punch-positioning member provided with said punch-positioning projection, said punch-positioning member being selected so that the punch-positioning projection provided thereon suits the type of punch to be used, the number of holes desired to be perforated in the paper sheets, and the desired positions of such holes, said selected punch-positioning member being interchangeably attachable to said sheet-retaining member.

20. A perforator according to claim 19, wherein magnetic plates are fastened to opposed surfaces of said sheet-retaining member and said interchangeable punch-positioning member so that said punch-positioning member may be detachably fastened to said sheet-retaining member by virtue of magnetic attraction generated between said two magnetic members.

21. A perforator according to claim 19, wherein a magnetic member is fastened to a surface of one of said sheet-retaining member and said interchangeable punch-positioning member and a metallic member is fastened to an opposed surface of the other of said sheet-retaining member and punch-positioning member so that said punch-positioning member may be detachably fastened to said sheet-retaining member by virtue of magnetic attraction generated between said magnetic member and said metallic member.

22. A perforator according to claim 12, wherein an elastically deformable member adapted to keep said upper sheet retainer member at an angle relative to said lower sheet retainer member during insertion of paper sheets between said upper and lower sheet retainer members is provided at at least one end of at least one of the upper and lower sheet retainer members.

* * * * *